US007667118B1

(12) United States Patent
Behn

(10) Patent No.: US 7,667,118 B1
(45) Date of Patent: Feb. 23, 2010

(54) MOUTHPIECE FOR A WOODWIND MUSICAL INSTRUMENT

(76) Inventor: Bradford Behn, P.O. Box 2650, 103 Noland Ct., Lyons, CO (US) 80540

( * ) Notice: Subject to any disclaimer, the term of this patent is extended or adjusted under 35 U.S.C. 154(b) by 0 days.

(21) Appl. No.: 12/251,608

(22) Filed: Oct. 15, 2008

(51) Int. Cl.
*G10D 7/00* (2006.01)

(52) U.S. Cl. ..... 84/383 R

(58) Field of Classification Search ..... 84/380 R, 84/383 R, 383 A
See application file for complete search history.

(56) References Cited

U.S. PATENT DOCUMENTS 4,430,920 A * 2/1984 Werschnik ..... 84/382
5,105,701 A * 4/1992 Hall et al. ..... 84/383 R
2004/0011182 A1 * 1/2004 Ruan ..... 84/278

FOREIGN PATENT DOCUMENTS

FR 2682514 A1 * 4/1993

* cited by examiner

*Primary Examiner*—Kimberly R Lockett
(74) *Attorney, Agent, or Firm*—Gottlieb, Rackman & Reisman, PC

(57) ABSTRACT

A mouthpiece for a single reed musical instrument, such as a clarinet, is made with a tubular body having an outer surface and having a facing angle. The mouthpiece is made so that its facing angle is 4 degrees or less to enable musicians to play music with much fuller and more pleasant sounds then in the prior art.

20 Claims, 5 Drawing Sheets

MOUTHPIECE FOR A WOODWIND MUSICAL INSTRUMENT

RELATED APPLICATIONS

None

BACKGROUND OF THE INVENTION

A. Field of Invention

This invention pertains to an improved woodwind mouthpiece for an instrument, such as clarinet, that provides an improved sound, response, and feel. The mouthpiece has several new features including geometry changes that allow for a steeper facing angle that is not in excess of 4 degrees, a less obtuse relationship between the bore and the chamber, a longer chamber that is at least 1.5 inches, and a deeper baffle at the point where the bore and baffle meet. These innovations create improved ergonomics for the player's comfort, more depth of sound, better response, and more stability, for instrumentalists of all levels.

B. Description of the Prior Art

The clarinet, invented in the early 1700's is a member of the woodwind family of instruments that along with the saxophone and in some cases the oboe and bassoon use a mouthpiece and reed for its source of vibration. The mouthpiece has a window, facing, sound baffle, chamber, and a bore, and it can easily be mounted to the body of its instrument or removed when necessary. A single flat cane or synthetic reed is clamped to the mouthpiece facing that is over the sound baffle and opening. The reed subsequently vibrates when a player blows into the top portion of the mouthpiece.

In an attempt to improve playability such as intonation, tone, and response, since their origination, there have been numerous modifications made not only to clarinets and all other single reed instruments, but also to their mouthpieces. Today, there remain structural differences between clarinets depending on country of origin. For instance, the bores associated with mouthpieces and clarinets designed and produced for the German school of playing are generally larger in dimension than instrument and mouthpiece bores of the French school of playing. These differences in bore size and key configuration attributed to the French-Boehm and German-Ohler systems also require mouthpieces that are made with slightly different bore sizes and internal details, and the change in physical characteristics of the clarinet body or mouthpiece results in a change in the tonal quality and playing techniques associated with each instrument.

So in an ongoing pursuit for a better playing experience, music instrument technicians continue their efforts to improve mouthpieces by changing various physical characteristics to make them more comfortable for a player to use, and help a player produce a better tone. The numerous components of mouthpiece design, that when altered create meaningful change in a musician's playing experience include the bore, chamber, baffle, throat, rails, window, and facing. The bore, is the tube that connects into the clarinet and can be altered by both width and length, but must balance with the chamber volume to maintain the correct total volume for ideal intonational characteristics. The chamber must be of the correct volume for pitch, but it can vary in shape as the sidewalls can be tilted to create an "A-frame" shape or they can be parallel. If the sidewalls are narrower, the tone is more concentrated whereas a wider throat and greater "A-frame" angle creates a broader tone, and less resistance. The floor of the chamber is also known as the baffle. When the baffle is deeper the sound becomes softer and when the baffle is higher, especially near the tip, the sound becomes brighter. The baffle shape also influences the speed of resonance and response. The window can vary in length and width, but when made too wide, the tone becomes more diffused and lacks core, whereas a window that is too narrow can create a tight, resistant feel that is resistant to the air. The facing has two components; the table and the curve. The curve, although not easily visible to the eye is the part of the mouthpiece that the reed vibrates against, and it curves downwardly toward the tip of the mouthpiece. Altering the gap and creating different tip openings and or types of curve (elliptical, radial) have important influence over all elements of the playing experience. The table is the part of the mouthpiece that the reed is fastened to, and it is best produced with either a flat or concave surface. All of these components influence one another and their correct balance is important in influencing a musicians sound, response, pitch, or overall playing experience.

A further parameter that has an important effect on the sound from a clarinet is the playing posture of the player, i.e., the angle at which the instrument is held. Clarinet teachers around the world instruct their students to hold the clarinet closer to their body as opposed to a more horizontal trumpet-like playing posture that has been adapted by jazz clarinetists (such as the late Benny Goodman) who often play with the clarinet oriented outward towards a more horizontal alignment. However the existing clarinet mouthpieces are shaped such that they do not promote an optimal posture and, hence, the sound produced by the clarinet is not as good as it could be.

SUMMARY OF THE INVENTION

The present invention provides a clarinet mouthpiece having a completely different design selected to invite and promote a more vertical playing posture. More particularly, the present invention pertains to a mouthpiece for a single-reed musical instrument with a body having an outer surface with top defining a facing angle, a first end arranged and constructed to be mounted on a musical instrument and a second end with a window accepting a reed; wherein said facing angle does not exceed 4°. Preferably, the mouthpiece has a longitudinal axis, a longitudinal bore extending along said axis to an inner end and a chamber extending between said inner end and said window. The longitudinal bore and said chamber are disposed at an obtuse angle. The longitudinal bore and the chamber are arranged and constructed so that no line of sight exists that can extend between said first end and said window. The facing angle ranges between −6° and 4°.

The invention further provides a method of making a mouthpiece for a musical instrument of the kind having a tubular body with an inner bore having a bore axis, an outer surface with a window, said outer surface defining a facing angle, wherein the method includes forming said mouthpiece with a facing angle that does not exceed 4°.

In another aspect of the invention, a method is provided for designing an improved mouthpiece for a musical instrument comprising the steps of starting with a standard mouthpiece having an elongated body with an internal bore and a bore length, an external surface with a face, said face having a window, with a window chamber extending at an angle between the window and an end of the bore, said face defining a face; and reducing said facing angle so that it does not exceed 4°. Preferably, the face angle is in the range of 4°-(−6°)

DETAILED DESCRIPTION OF THE INVENTION

Figure 1A:
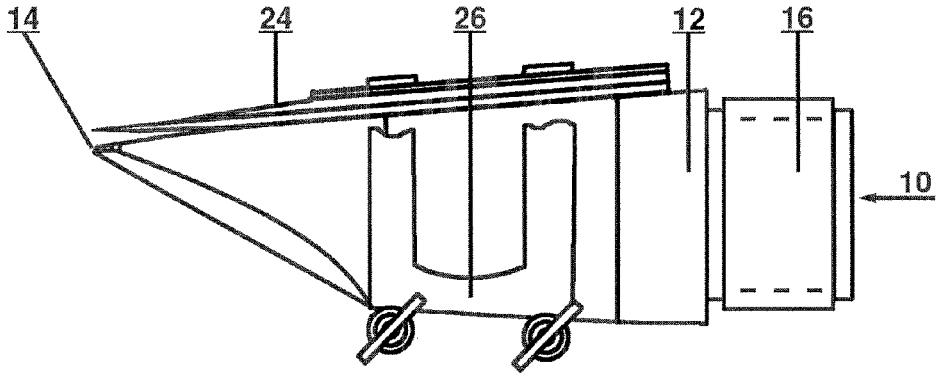
Fig. 1A PRIOR ART
FIGS. 1A, 1B and 1C show a side, a top and a side sectional view of a typical clarinet mouthpiece.
Figure 1B:
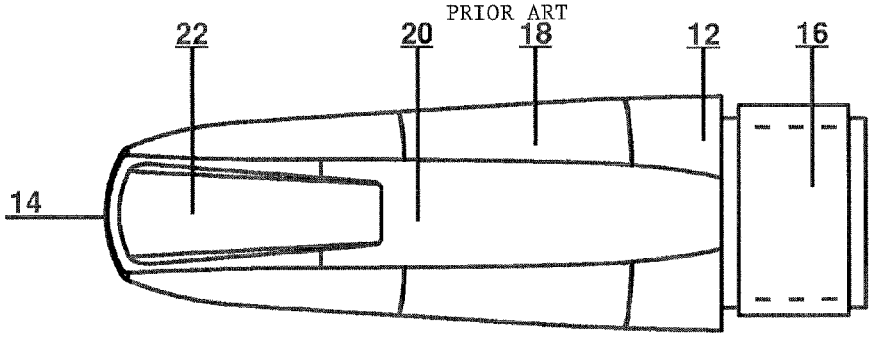
Fig. 1B PRIOR ART
Figure 1C:
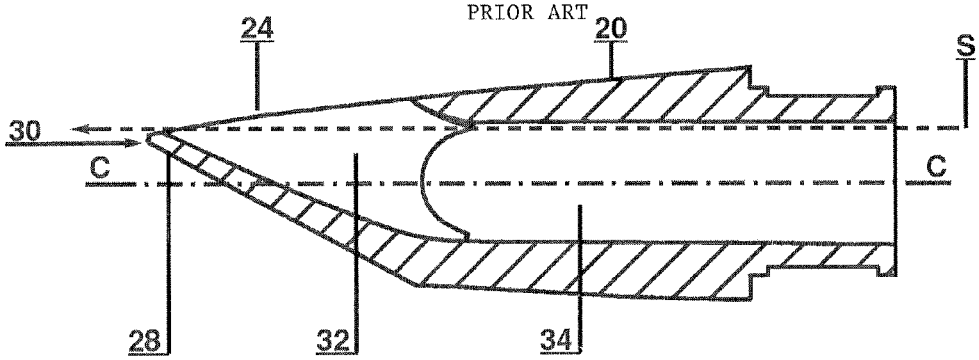
Fig. 1C PRIOR ART

FIGS. 1A-1C show a standard or prior art mouthpiece 10 having a generally tubular body 12 having a first end 14 and a second end 16. As described in more detail below, the first end 14 is structured to receive a reed and is the part that is inserted in the mouth and blown while the clarinet is played. The second end 16 has a reduced diameter so that it can be inserted telescopically into a clarinet (not shown).

Body 12 has a generally conical surface 18 with a top surface or face 20 that is planar. A window 22 opens in face 20 and is covered by a reed 24 attached to the body 12 by a ligature 26. The reed 24 and the ligature 26 are standard elements and are omitted from the remaining drawings for the sake of clarity. As best seen in FIG. 1C, an end segment 28 of the surface 18 curves slightly downwardly to form a wedge-shaped opening 30 between the reed 24 and the body 12. The player makes sounds by blowing through this opening 30 into window 22. The window 22 is in communication with a mouthpiece chamber 32 leading to a central bore 34 extending through the body 12. This bore 34 is co-axial with a similar bore (not shown) in the clarinet itself and is slightly conical. More specifically, the cross-sectional diameter of the bore 34 narrows as the bore 34 approaches chamber 32. Details of a standard prior art mouthpiece of this type are found for example in U.S. Pat. No. 5,105,701.

Figure 2:
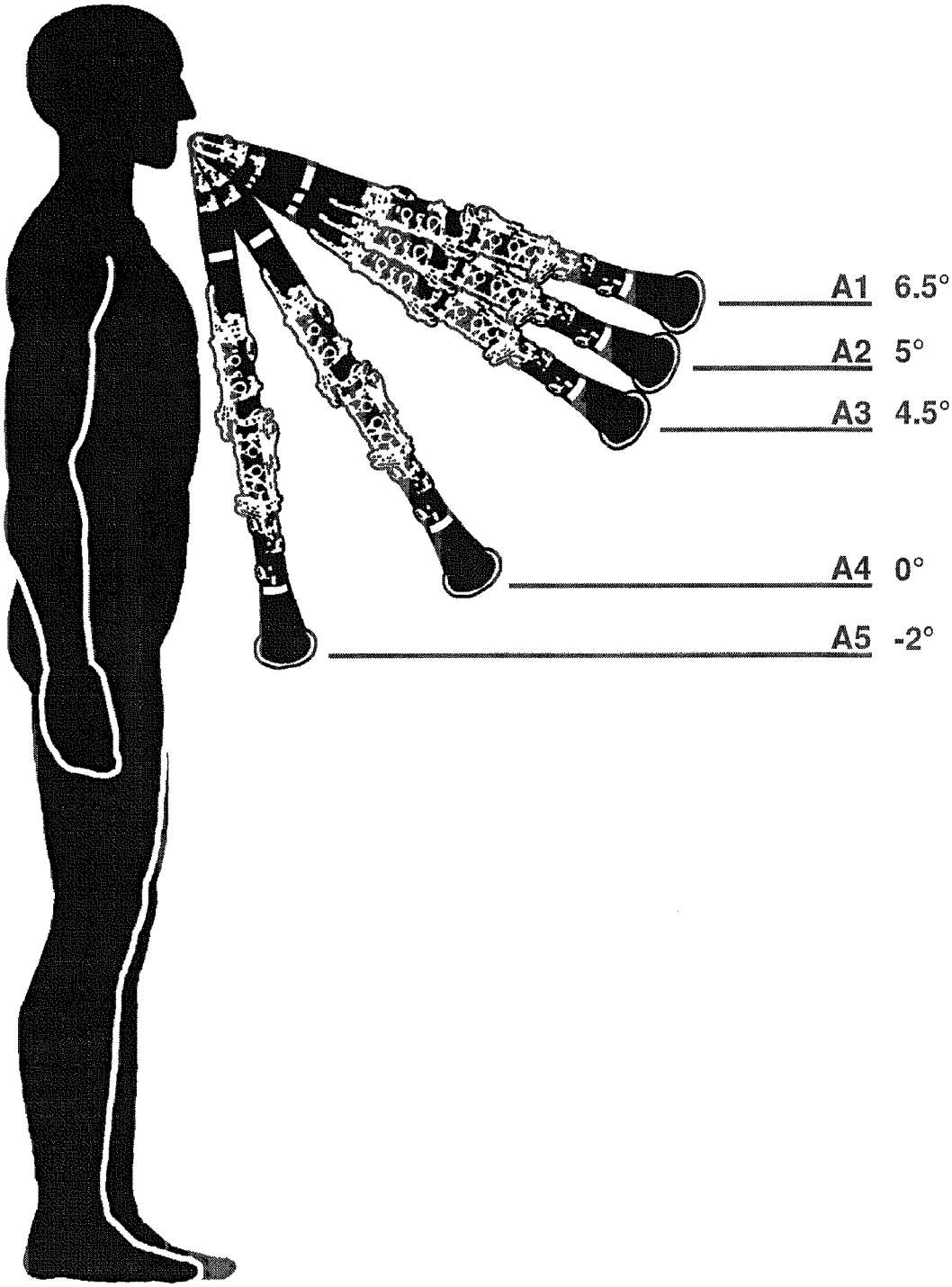
FIG. 2 shows somewhat diagrammatically various angles of play that can be used with a clarinet, the angles being somewhat exaggerated for clarity.

A clarinet with mouthpiece 12 is held by a player so that the window 22 is facing the player. The playing posture used by a clarinet player is dictated somewhat by the facing angle of the mouthpiece. This facing angle is defined as the angle between the face 20 and the longitudinal axis X-X of the bore 34. It should be clarified that at a facing angle of 0° the mouthpiece is standing on a table, the facing is vertical. If the angle is the negative, the facing leans at an acute angle relative to the table plane; and if it is positive, the facing angle is obtuse, in relation to the table plane). When the clarinet is brought closer to the body, the sound often "opens-up" and becomes fuller, more stable and easier to control. Thus, the facing angle is related to the way the mouthpiece interfaces with the player's mouth and it influences the angular relationship of the clarinet to the clarinetist's body. As discussed above, a problem with prior art mouthpieces is that they are typically made with a facing angle of 5° or more, and mouthpieces having a facing angle of even 4.5° are very rare. In fact many mouthpieces are cut to an angle in the extreme range of 6-6.5°. Of course, the larger or slacker the facing-angle is, the more horizontal the clarinet-posture becomes. This concept is illustrated in FIG. 2, wherein postures with axes A1, A2, A3, A4, A5 correspond to facing angles of 6.5°, 5.0°, 4.5°, 0° and −2° respectively. Axes A1 and A2 are not very desirable because they are much closer to the clarinet being positioned horizontally, then at the other angles. However, as discussed above, until now all clarinet mouthpieces were formed with their surfaces 20 disposed at angles that promoted postures at axes A1 and A2 and no mouthpieces were made or suggested with facing angles of less than 4.5°.

The present inventor (who is also a professional clarinet player) has found that by providing a mouthpiece with a facing angle that is smaller than that provided by the art promotes a steeper playing position. In other words, such a mouthpiece promotes holding the clarinet to a more vertical posture.

In other words, the present inventor has found that, contrary to past practice, a mouthpiece facing angle that does not exceed 4.0° has much better acoustic properties then prior art mouthpieces. These advantages are discussed in more detail below. Of course, there are many different ways in which one can design a mouthpiece with such an angle. The present inventor has discovered that a preferable way of designing such a mouthpiece is to take a standard mouthpiece and change the angle of face 20 and chamber 32, without changing the angle or orientation of the longitudinal axis of tube 34. In addition, all the other external dimensions of the mouthpiece are maintained the same, such as the overall length of the mouthpiece and the size and distance of the window 22 from the tip of the mouthpiece.

Moreover some of the internal dimensions of the mouthpiece remain the same as well. More specifically, the various internal cavities are sized and shaped so that the overall internal volume remains the same. Of course, since the position of the window remains the same, the increase in the facing angle results in an increase in the length of the chamber. In typical mouthpieces with a facing angle of 5° the chamber length is 1.450". For a typical mouthpiece with a facing angle of 6°, the chamber length is 1.402". In the mouthpieces constructed in accordance with the present invention, the chamber lengths are in the range of 1.500" to 1.623" (at a facing angle of −4°). Of course, a longer chamber results in a deeper baffle, and therefore increased depth at the point at which the chamber and bore meet.

Designing or shaping the mouthpiece in this manner results in several advantages (in addition to the improved playing stance).

Most of the dimensions of the new mouthpiece are identical to the measurements of the standard mouthpiece and the bore 32 remains coaxial with the bore of clarinet, and, therefore, the 'look-and-feel' of the new mouthpiece remains similar As a result, a player will be comfortable with the new mouthpiece and will not have to worry that he will have to change his playing techniques in any way;

The end 16 of the mouthpiece can remain the same and therefore the mouthpiece is mounted the same way on the clarinet.

The player can use the same ligature 26 to mount reed 24;

The window chamber 32 is longer (1.5" or more); and

The angle between the bore axis and the window chamber axis is more acute.

A smaller facing angle and the design selected by the inventor to achieve this smaller facing angle lead to several improvements over the standard mouthpiece such as:

A more vertical playing posture (as discussed above), creates a less direct source of sound, and the clarinet generates a sound that is mellower, less strident, and blends better with orchestral and band settings;

The center of balance of the instrument is closer to the body, and this creates a more comfortable playing posture and less fatigue when playing for long periods of time. The novel mouthpiece also improves the effectiveness of the neck-strap (not shown);

The changes in the internal dimensions discussed above such as the chamber length, baffle depth, and more acute chamber angle result in a better sound, that is deeper, fuller and less strident;

As a result of the changes in the internal dimensions, the novel clarinet mouthpiece has a better feel and provides more air flow resistance. The present inventor believes that increased air flow resistance is advantageous because it allows a player to select reeds that are softer, more vibrant, and allows the player to achieve better stability and flexibility of sound, more secure and reliable response and better tone quality with more comfort and ease than with prior mouthpieces;

Maintaining the same general mouthpiece shape, size and weight as the prior art mouthpiece (the change in the weight of the mouthpiece due to the lowering of the facing angle is minimal) insures similar vibrational resonance, and when compared to a heavier mouthpiece or a mouthpiece having thicker walls, better vibrational resonance; (a thicker walled and heavier mouthpiece produces a more dampened and dull sound).

Figure 3A:
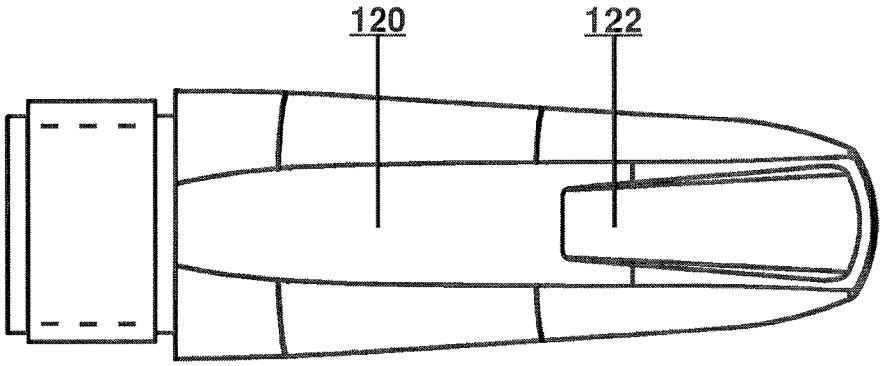
FIGS. 3A, 3B and 3C show a top, a side and a sectional view of a mouthpiece constructed in accordance with this invention.
Figure 3B:
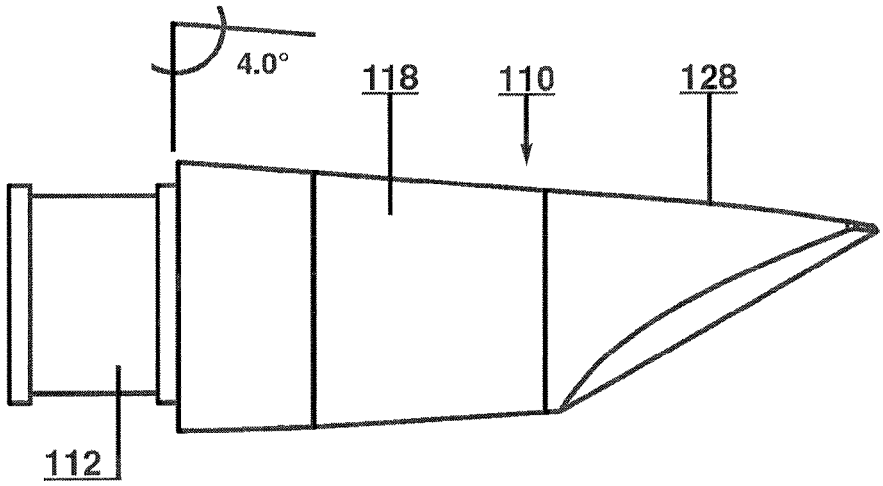
Figure 3C:
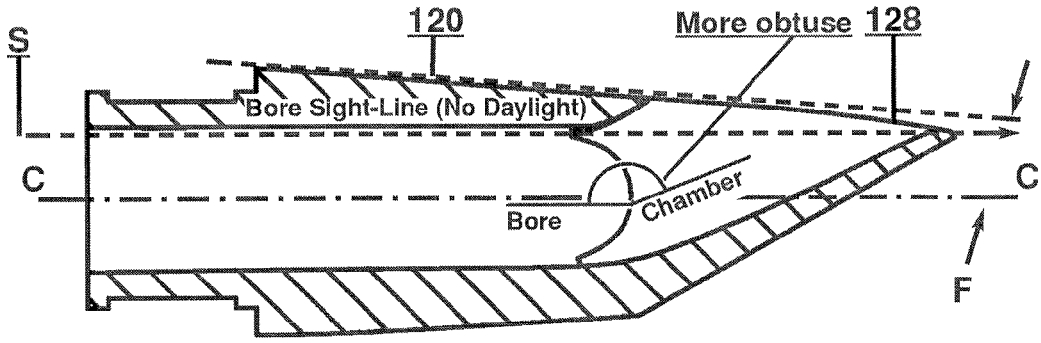

One such mouth piece 110 is shown in FIGS. 3A, 3B and 3C. It has a generally tubular body 112 with a conical surface 118, a somewhat flat face 120 with a window 122. A portion 128 of the face 120 curves down to provide an opening under a reed (not shown) when such a reed is installed. This mouthpiece has a slightly smaller 4.0° facing angle F than prior art mouthpieces (a reduction in the range of between 0.5°-2.5°).

Figure 4A:
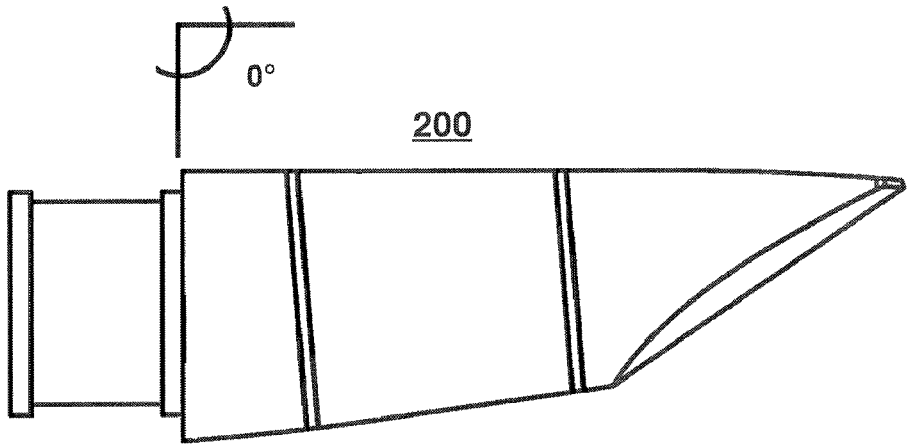
FIGS. 4A and 4B show a side and a sectional view of another embodiment of the invention.
Figure 4B:
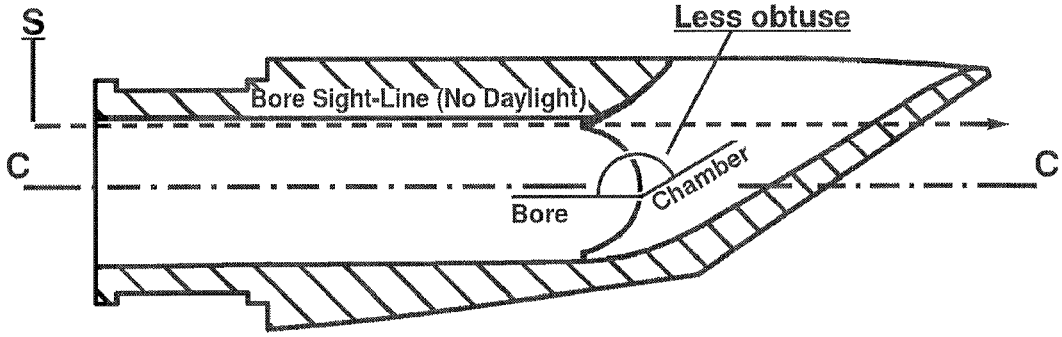

This concept was extended further by designing two more embodiments. The second embodiment 200 is shown in FIGS. 4A and 4B. This embodiment has a facing angle of 0°, 4° less than the embodiment of FIGS. 3A-3C and 6.5° less than some conventional prior art mouthpieces. This mouthpiece created a very noticeable change in posture (e.g., 4.5-6.5° more vertical) and has significant tonal and "feel" improvements. More over the added resistance caused by sympathetic internal changes (more acute baffle-bore relationship) and increased depth within the chamber made for a deeper sound, larger body of sound, and more stable playing experience.

Figure 5A:
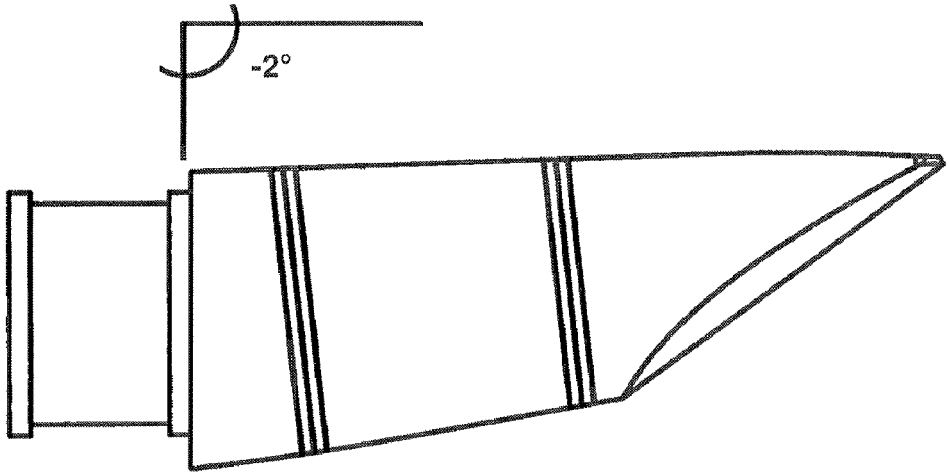
FIGS. 5A and 5B show a side and a sectional view of yet another embodiment of the invention.
Figure 5B:
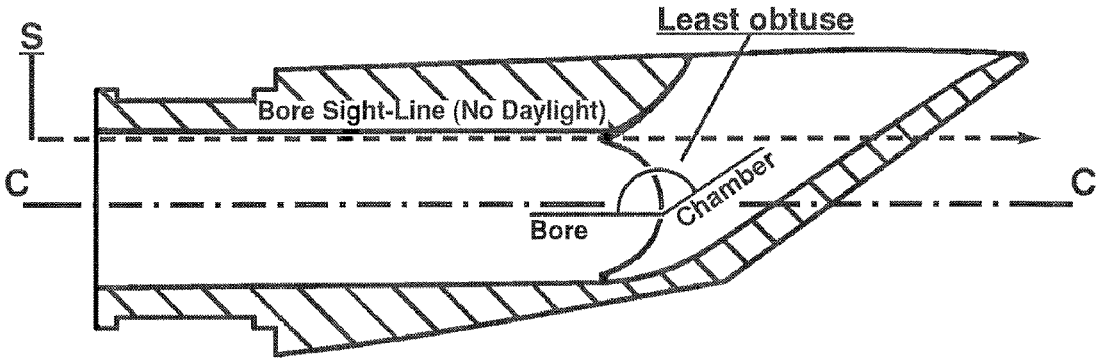

The inventor has also constructed mouthpieces with facing angles of −2° and −4° and found that these mouthpieces performed better than the prior art mouthpieces. FIGS. 5A and 5B show a mouthpiece with a facing angle of −2°. The structure of the mouthpiece with a facing angle of −4° is similar to the ones in FIGS. 3, 4 and 5 and therefore it is not illustrated in this application As discussed above, an important benefit of the present invention is that, the relationship of the chamber to the bore had to become more acute, as the facing angles grew steeper. This more acute relationship results in a design that has a longer and deeper chamber. This adds tonal depth and improves the player's feel by increasing the resistance to air flow.

As discussed above, a further benefit of the present design is that it results in an increase in the air resistance to air flow through the mouthpiece as compared to other prior art designs. Many designers of mouthpieces strive to decrease air resistance in a mouthpiece. Apparently in the belief that a reduced resistance is very beneficial. However the present inventor believes that, contrary to the popular thought, a better playing experience is achieved with a proper balance of resistances. The resistance is necessary to help create a stable playing experience. If the mouthpiece has more resistance it allows one to use a more flexible vibrant reed. A reed must respond easily and freely but it also must be stable. The reed influences the tone produced by the instrument. With better, or more balanced resistance characteristics from the mouthpiece, the duplicitous nature of the reed to both freely vibrate, and resist the wild loose feeling of too much freedom becomes reduced. In the inventor's opinion, the player's search for good reeds can move more towards vibration and the player can let the mouthpiece provide more resistance. These characteristics also make it easier for a player to select suitable reeds for the mouthpieces.

Thus, changing the angle a clarinet is played to be more vertical, is associated with several benefits.

One of these benefits is a steeper facing angle. Previous designs represent a facing angle that is at least 4.5° but generally much larger. As discussed above in the present invention, this angle has been reduced to one of the following; 4°, 0°, −2°, and −4° and can be reduced even further to −6°.

Moreover another benefit is a more acute bore-chamber relationship. As the facing angle becomes steeper so does the bore-chamber relationship. This relationship becomes evident from a simple sighting test. Returning to FIG. 1C, if one holds the mouthpiece without a reed, and sights along direction S through the bore toward the window, he will see daylight. On the other hand if one sights along direction S in FIGS. 3C, 4B and 5B, one can not see daylight. This is a quick visual technique one can use to determine if the chamber-bore relationship is acute enough. This sightline test is something that easily illustrates a difference between the inventive structure and the prior art.

To summarize, the present inventor has developed a new way to design mouthpieces for wind instruments, such as clarinets. Some of the key features and benefits of the present invention are listed below:

External Geometry: Facing angle of 4°, 0°, −2°, −4°, −6°
more acute baffle-bore relationship
Bore sightline: Can't see daylight
Longer chamber for added depth of tone
Deeper baffle for added depth of tone The present invention was described in conjunction with a clarinet, however it is applicable to many other instruments and more particularly to single-reed musical instruments.

Numerous modifications may be made to this invention without departing from its scope as defined in the appended claims.

I claim:

1. A mouthpiece for a single-reed musical instrument:

a body having an outer surface, a first end arranged and constructed to be mounted on a musical instrument and a second end having a top surface formed with a window accepting a reed;

said body being formed with a longitudinal bore with a longitudinal axis extending partially therethrough, said body further including a mouthpiece chamber extending between said longitudinal bore and said window;

wherein said top surface defines a facing angle with said longitudinal axis that does not exceed 4°.

2. The mouthpiece of claim 1 wherein said longitudinal bore and said mouthpiece chamber are disposed at an obtuse angle.

3. The mouthpiece of claim 1 wherein said longitudinal bore and said chamber are arranged and constructed so that no line of sight exists that can extend between said first end through said longitudinal bore, said mouthpiece chamber and said window to allow a viewer to see through said mouthpiece.

4. The mouthpiece of claim 1 wherein the musical instrument has a longitudinal aperture and said longitudinal bore is coaxial with said longitudinal aperture.

5. The mouthpiece of claim 1 wherein said facing angle is one of about 4°, 0°, −2, −4°, and −6°.

6. The mouthpiece of claim 1 wherein said facing angle is between −6° and 4°.

7. The mouthpiece of claim 1 wherein said chamber has a length of at least 1.500".

8. A method of making a mouthpiece for a reed musical instrument of the kind having a tubular body with an inner bore having a bore axis, an outer surface having a top surface with a window accepting a reed for the instrument, said top surface defining a facing angle with said bore axis, said method comprising forming said mouthpiece with a facing angle that does not exceed 4°.

9. The method of claim 8 wherein said mouthpiece is made with a facing angle of between 4° and −6.0°.

10. The method of claim 9 wherein the facing angle is one of about 4°, 0°, −2°, −4° and −6°.

11. The method of claim 8 further comprising providing said mouthpiece with a chamber extending at an obtuse angle from said inner bore to said window.

12. The method of claim 11 further comprising arranging said bore and said chamber so that no sight line can exist between an open end of said bore and said window along which a viewer can look through said bore, said chamber and said window.

13. The method of claim 8 further comprising providing a window chamber from the window to the bore that has a length of at least 1.500".

14. A method of designing an improved mouthpiece for a musical instrument comprising the steps of:

starting with a standard mouthpiece having an elongated body with an internal bore extending longitudinally at least partially through said elongated body and having a bore axis and a bore length, an external surface with a face, said face having a window, with a window chamber extending at an angle between the window and an end of the bore, said face defining a face angle with said bore axis; and reducing said face angle so that it does not exceed 4°.

15. The method of claim 14 wherein said face angle is in the range of 4°-(−6°).

16. The method of claim 14 wherein said standard mouthpiece includes a window and window chamber extending to said bore, further comprising maintaining the volume of said bore and said window chamber constant while said face angle is changed.

17. The method of claim 14 wherein said standard mouthpiece includes a window and a window chamber with a length further comprising increasing said length to at least 1.500".

18. The method of claim 14 further comprising maintaining the axial length of said bore constant while changing said face angle.

19. The mouthpiece of claim 1 wherein said top surface is planar.

20. The method of claim 8 wherein said top surface is planar.

* * * * *